United States Patent [19]

Lawrence

[11] 4,296,561

[45] Oct. 27, 1981

[54] PICTURE FRAME HAVING INTEGRAL LATCHING MEANS

[76] Inventor: Peter Lawrence, 33 E. 22nd St., New York, N.Y. 10010

[21] Appl. No.: 127,328

[22] Filed: Mar. 5, 1980

Related U.S. Application Data

[63] Continuation-in-part of Ser. No. 34,545, Apr. 30, 1979.

[51] Int. Cl.[3] ..... A47G 1/06; G09F 1/10

[52] U.S. Cl. ..... 40/158 R; 40/152.1

[58] Field of Search ..... 40/158, 152.1, 152

[56] References Cited

U.S. PATENT DOCUMENTS

| | | | |
|---|---|---|---|
| 1,879,251 | 9/1932 | Horbauck | 40/603 |
| 2,410,989 | 11/1945 | Mevi | 40/155 |
| 2,443,234 | 6/1948 | Ford | 40/152.1 |
| 2,504,277 | 4/1950 | Otterson | 40/152.1 |
| 2,598,755 | 6/1952 | Birch | 40/158 R |
| 2,833,070 | 5/1958 | Goldman | 40/152.1 |
| 2,919,512 | 1/1960 | McDonald | 40/152.1 |
| 2,942,368 | 6/1960 | Gale | 40/158 R |

FOREIGN PATENT DOCUMENTS

| | | | |
|---|---|---|---|
| 582775 | 11/1946 | United Kingdom | 40/152 |
| 837787 | 6/1960 | United Kingdom | 40/152 |

*Primary Examiner*—Gene Mancene
*Assistant Examiner*—Wenceslao J. Contreras
*Attorney, Agent, or Firm*—Ostrolenk, Faber, Gerb & Soffen

[57] ABSTRACT

The disclosure concerns a picture frame including an inflexible planar base and a flexible cover comprised of clear synthetic resinous material. The cover may be printed or have a layer applied on a surface thereof to form a border. The cover is provided at one edge or perhaps at a pair of opposed parallel edges, with a glued latch element. This element engages a corresponding edge on the base in the space between the latch element and the inner surface of the cover. The latch element is disengaged for the insertion of a print or photo by bending the cover adjacent the latch element for sliding the latch element off the base, inserting the print and then reinstalling the latch element on the base. Upon release of the latch element, the resiliency of the cover returns the latch element to the engaged position over the respective edge of the base.

22 Claims, 8 Drawing Figures

100
102
104
106
108
112
114
116
120
122
124
128
129
130
132
134
136
138
142
150
152
153
154
156
158
160
8

PICTURE FRAME HAVING INTEGRAL LATCHING MEANS

CROSS REFERENCE TO RELATED APPLICATION

This is a continuation-in-part of application Ser. No. 34,545 filed Apr. 30, 1979.

BACKGROUND OF THE INVENTION

This invention relates generally to the field of lightweight picture frames or folders comprised of laminae which are mutually interconnected along at least one edge thereof to form an interstice into which a photograph or print is inserted. Frames or folders of this general type are known in the art. The invention lies in a manner of connecting by easy latching, the front cover of the frame to the rear base member with a photograph or print between them, for both securely holding the print and for retaining the front cover in a flat condition.

Known prior art includes the widely used two lamina construction in which a base member with or without a folding cover is glued to an orificed lamina along an upper edge. The second mentioned lamina is provided with a die cut opening, the edges of which form a margin for a print positioned therebeneath. While useful, and relatively inexpensive to manufacture, this type of frame, in use for at least the last 75 years, has little contemporary aesthetic appeal.

A relatively more expensive frame, also known in the art, involves the use of a relatively rigid base of fibrous material and an equally rigid clear plastic cover held in position upon the base by the use of resilient clips which engage edge portions of both members, the desired print and an orificed member superposing the print being sandwiched therebetween. This construction, while attractive in appearance, requires considerably more material during fabrication, and the cost of the finished article is augmented by the cost of the clips, usually at least two in number.

A third construction, somewhat cheaper, employs a rigid base and a cover of heavy gauge cellulosic material, two edges of which are shaped to form a pair of oppositely facing recesses capable of receiving opposed edges of the base which is laterally slid into engagement with the cover, the engagement forming an interstice into which a print is simultaneously inserted. See, for instance, U.S. Pat. Nos. 2,746,191 and 2,833,070. Assembly is not particularly convenient, and the most prevelent use of this form has been confined to devices of relatively modest size, used for display of individual photographs.

To date, there has been no form of frame of the class described in extended use which offers the combined attributes of low cost, convenience in manufacture and use, and a contemporary, expensive appearance.

SUMMARY OF THE INVENTION

The invention contemplates the provision of an improved, preferably low-cost, frame of the type described. The frame includes a relatively rigid flat base, comprised of heavy-duty paper board, plastic material, etc. A cover overlies one surface of the base member. At least part of the cover is flexible for bending, and the cover is preferably of non-stretchable material. The cover may be comprised of a flexible sheet of clear material, e.g. a transparent plastic, or it may be a flexible sheet with a cut out opening through it for permitting viewing of the photograph or print behind the cover. In one preferred embodiment, the cover comprises a sheet of relatively heavy gauge clear Mylar, or other synthetic resinous material having similar properties.

It is often desirable for the print or photograph to be surrounded by a decorative frame border. One way of accomplishing this is to provide the inwardly facing surface of the cover with printing along the marginal edge portions thereof using a compatible opaque ink to form a clear centrally disposed area. The ink layer masks the edges of a photograph or print disposed therebeneath. Alternatively, the outwardly facing surface of the cover may be printed with opaque ink.

Another technique of applying a border comprises laminating appropriate material, e.g. a strip of opaque material, around the marginal portions of the clear cover. The applied material should be flexible like the cover to which it is applied. Other techniques for defining a border on the cover can be envisioned.

The invention is particularly concerned with latching means for conveniently engaging and disengaging at least one edge of the cover to the corresponding edge of the base. The latching means comprises a rigid latching element attached at the rear surface of the cover. The latching element extends over the corresponding edge of the base and has a flap that extends down behind the base. This defines a groove between the flap and the cover into which that edge of the base extends. Inside the groove, the latching element includes a surface that may also engage that edge of the base and that may also press down upon that edge, so that with the base in the groove, and the flap behind the base, the cover is held flat and may also be generally stretched taut. The resiliency of the cover also holds it in position.

One embodiment of the latching means comprises two strips laminated together and preferably comprised of the same material that is employed to form the base. The strips are of unequal height along the cover member, with the outer strip, which defines the flap, extending further down along the cover member. The strips are glued in off-set relation to each other and to a portion of the rear or inner surface of the cover and their different heights define the groove or recess which receives the edge of the base The strips may be integrated into a single molded or extruded latching element.

If desired, two of the latching means may be provided at a pair of opposed edges of the cover In such an embodiment, each of the latching means will operate in the same way.

In a further modification of the invention, the base may be comprised of two laminae, one of which is hinged to the other and can be swivelled away from the other for defining an easel for enabling the frame to be stood up.

Accordingly, the primary object of the present invention is to provide a simple frame for a picture, photo, or the like which frame can be light weight and inexpensive to manufacture.

It is another object of the present invention to provide such a frame which has a flexible cover sheet, and the flexible cover sheet thereof is enabled to be applied smoothly over the picture, photograph, or the like held in the picture frame.

It is another object of the present invention to provide latching means for such a picture frame for latching the cover of the picture frame over the base thereof.

The foregoing and other objects and features of the invention will be apparent from the following description and the accompanying drawings.

DESCRIPTION OF THE PREFERRED EMBODIMENTS

Figure 1:
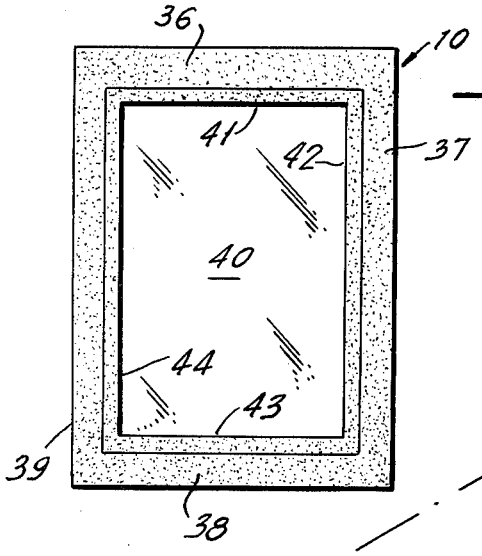
FIG. 1 is a front elevational view of an embodiment of the invention.
Figure 2:
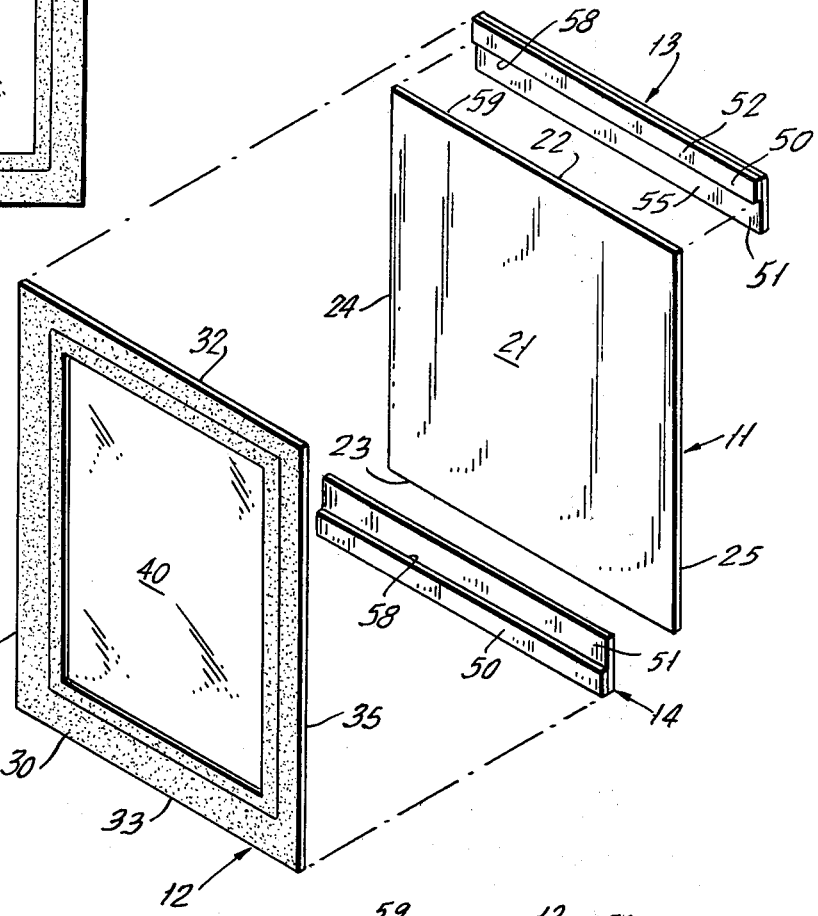
FIG. 2 is an exploded perspective view thereof.

The first embodiment of picture frame 10, comprises a base 11, a cover 12 and latching means 13 and 14.

The base 11 is a flat rectangle preferably formed from paper board stock. The thickness of the material is selected so that the base will be substantially rigid. A rigid plastic sheet may also be used as the base.

The cover 12 is of corresponding size and configuration to the base 11 and is formed from moderately heavy gauge, transparent synthetic resinous material having a relatively high degree of resiliency. I have found Mylar of a thickness varying from 0.005 to 0.010 inches to be particularly suitable. The cover 12 includes an outer or front surface 30, and an inner or rear surface 31. It is bounded by upper, lower and side edges, 32, 33, 34 and 35, respectively. The inner or rear surface 31 is printed with an opaque ink in the marginal areas 36, 37, 38 and 39, to form a clear area 40 bordered by edges 41, 42, 43 and 44, beneath which a print or photograph is displayed. In the alternative, the border on the cover 12 may be applied on the exterior of the cover, or it may be comprised of strips of a flexible fabric or strips of a plastic, or the cover may even have no border at all.

The latching means 13 and 14 are similar. As a result, only one is described. The latching means are preferably formed from the same material which forms the base 11, although, if desired, they may also be formed as a synthetic resinous extrusion having similar configuration. The latching means includes a first relatively short height strip 50 and a second relatively greater height strip 51. The strips are glued together in offset relation with the strip 50 near to the outer edge of the strip 51. The strip 50 has planar surfaces 52 and 53 defining its opposite front and rear sides, while the strip 51 has planar surfaces 55 and 56 defining its opposite front and rear sides. The opposed surfaces 53 and 55 are glued together integrating the strips 50 and 51.

The surface 52 of strip 50 is glued to the surface 31 of the cover 12 and due to the thicknesses of strips 50 and 51 and their placements, this forms an elongated recess 57 under the surface 55 between that surface face and the rear surface 31 of cover 12. The front-to-rear thickness of the recess 57 corresponds to the thickness of the base 11. The placement of the strip 50 on the cover 12 is selected so that with the latch means latched in place on the base, the edge 58 of the strip 50 contacts the edge 59 of the base 11. This tightens the cover 12. In addition, the surface 55 of the strip 51 extends down behind and may rest against the base 11 and this helps keep the strip 51 flat, flattening the cover 11. Finally, the resilience of the material of the cover helps retain its flat condition.

Figure 4:
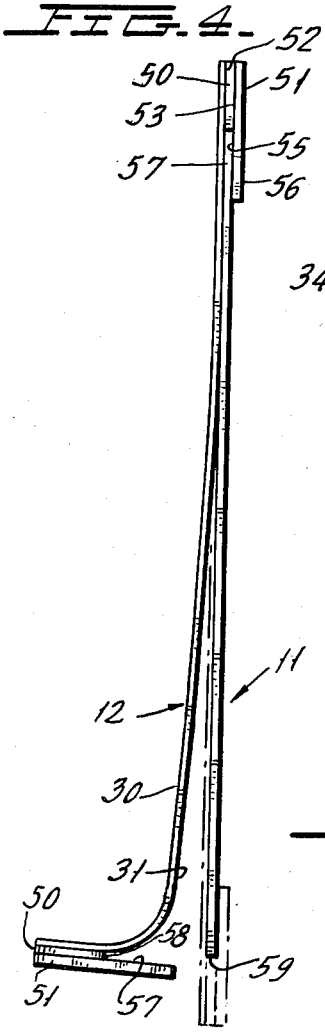
FIG. 4 is a side elevational view thereof, showing the disclosed embodiment in the frame cover opened condition.
Figure 3:
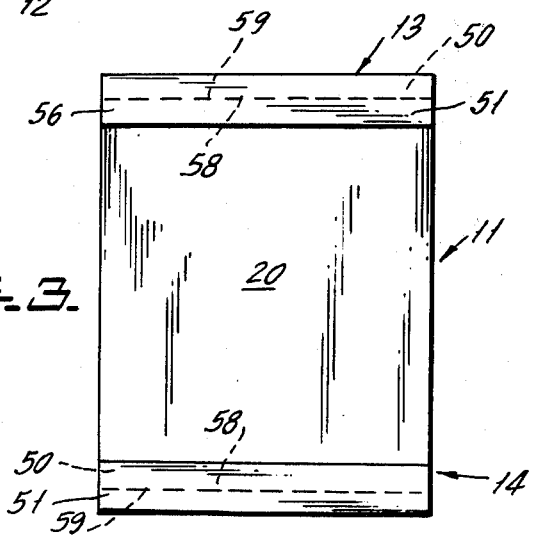
FIG. 3 is a rear elevational view thereof.

The operation of the picture frame of the invention will be apparent from FIG. 4. When it is desired to open a fully assembled frame for the insertion of a print, the latching means at one end is grasped and rotated to flex the cover 12 at the end through substantially a right-angle bend. This raises the surface 55 off the rear of the base 11 and moves the edge 59 of the base disposed within the recess 57 out of the recess. Following this, the cover 12 may be lifted to provide access to the space between the inner surface 31 of the cover and the base. A print (not shown) is then inserted and positioned to lie beneath the clear area 40. Then the cover is reclosed by again bending the cover 12 to the condition shown in FIG. 4, passing the surface 55 over the end edge 59 and then straightening out the cover 12, which moves the surface 55 behind the base 11, thus returning the cover to its initial position. It will be apparent that since only one of the latching means need be disengaged for this purpose, the other may be permanently glued in place to prevent total disengagement between the cover 12 and the base 11.

The second embodiment of picture frame 100 shown in FIGS. 5–8 has a number of differences over that shown in FIGS. 1–4.

The base 102 is comprised of a paper board or plastic material, substantially rigid sheet 104 which is rectangular in shape and serves as the same type of base as the base 11, discussed above. As easel 106 is hingedly connected at hinge connection 108 to the base sheet 104. The hinge connection enables the easel 106 to be pivoted between the closed, flattened position illustrated in FIG. 7 and the open position illustrated in FIGS. 5 and 8. When the base is comprised of paper board and the easel 106 is similarly comprised of paper board, for example, a single die cut sheet of paper board of the size of the base member 104 and the easel 106 combined is cut and then the hinge is formed by creasing or scoring in die cutting, of the single sheet to define the hinge at 108. Then the sheet is folded over to define the construction 104, 106 illustrated in FIG. 5.

Figures 5, 6, 7, 8:
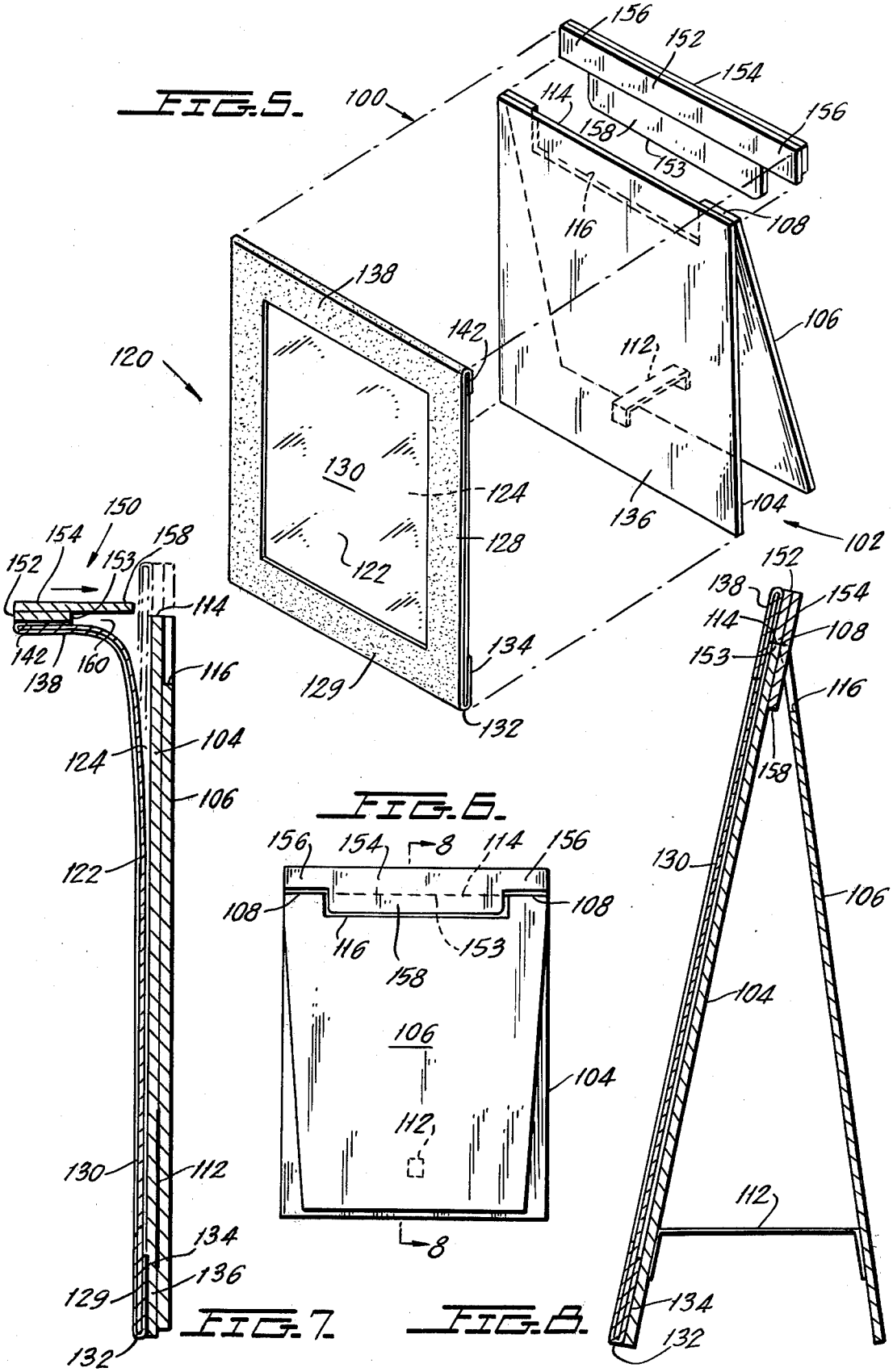
FIG. 5 is an exploded perspective view of a second embodiment of the invention.
FIG. 6 is a rear elevational view thereof.
FIG. 7 is a side elevational view thereof, showing this embodiment in the frame cover opened condition.
FIG. 8 is a cross-sectional view along the line in the direction of arrows 8—8 and showing this embodiment in the position of use thereof with the frame cover closed.

Confining the extent to which the easel may be opened, and establishing the proper supported position of the picture frame, as shown in FIG. 8, a flexible strap 112 extends between and is glued to the rear of the base 104 and the front of the easel 106. The strap folds flat when the frame assumes the position illustrated in FIG. 7.

The base 104 has a top edge 114 which engages the latch means, as described further below. With the easel 106 folded over behind the base 104 in the position illustrated in the drawings, the base would be doubly thickened, too thick for the latching means. Therefore, the top portion of the easel is cut out at 116, defining an open area in which the flap 158 of the latching means can be freely received. Thus the latching means installed over the base 104 will not interfere with opening and closing of the easel between the positions of FIGS. 7 and 8.

The cover 120, like the cover 12, is of corresponding size and configuration to the base 104 and the cover 120 is comprised also of relatively heavy gauge, transparent, synthetic resinous material, having a relatively high degree of resiliency. The same Mylar resin plastic material may be used as in the first embodiment. The cover has a front outer surface 122 and a rear inner surface 124. The cover 120 is bounded by the upper, lower and opposite side edges. For decorative purposes, a strip of textured, flexible, plastic material 128 is bonded to the marginal edge areas of the cover to define a frame or border around the transparent central portion 130 of the cover. Textured plastic material, paper, fabric or even a layer of paint or ink applied either to the outer surface 122 or to the interior surface 124 of the cover will satisfactorily perform the desired function, so long as it does not interfere with the flexing of the cover which is necessary to attaching and detaching the cover and the base. At the bottom of the frame, the marginal area strip 129 of textured covering material 128 is folded over the bottom of the plastic material of the cover 122 at the fold 132 and this defines a flap 134 of material behind the cover. This flap of material is adhered, e.g. by gluing, to the base 104 at the section 136 thereof and the flap 134 is secured to the rear surface 124 of the base, whereby the lower edge portion of the cover 120 is rigidly secured to the base 104.

At the top end of the cover 120, the marginal area strip 138 of decorative material on the cover is wrapped around the top end of the clear plastic cover 120. The marginal area 138 is folded over to define the rear flap 142 behind the cover 120.

The latching means 150 is applied at the rear surface 124 of the cover 120 toward the top edge of the cover. The latching means 150 is essentially the same in character as the latching means 13 or 14 discussed in connection with the first embodiment. In particular, the latching means 150 includes the inner strip 152 which is shorter in its height dimension and the width of which is selected to be as wide as the width of the base 104 for secure latching of the cover 120 to the base The height of the strip 152 is selected and its placement on the flap 142 of the strip 138 is selected so that the bottom edge 153 of the strip 152 will rest and press against the upper edge 114 of the base 104, thereby serving to stretch and flatten the cover 120 when it is installed on the base.

The second, outer strip 154 includes shorter height side edge portions 156 and includes the central longer flap section 158 which depends down the back of the base 104 and extends into the recess 116 defined in the easel 106. The flap section 158 defines the recess 160 between the flap and the rear surface 124 of the cover into which the upper edge 114 of the base extends for latching the latch means to the base.

The strip 154 is adhered to the outer surface of the strip 152 by gluing, whereby they become a single unit, as in the first embodiment. Preferably, also, the strips 152 and 154 are stamped or die cut from the same paper board as the base member. Within the contemplation of the invention, the strips 152, 154 may together be formed of a single element and may be comprised of a single plastic extrusion or molding, as desired.

Because the latching means 150 is not adhered by gluing to the base 104 and is instead latched by the flap 158 extending down behind the base 104 into the clearance space 116, in the event of slight manufacturing tolerance errors in cutting and assembling the elements of the frame and in the event of different rates of expansion of the cover 120 and the base 104 due to changes in ambient conditions, the cover will be able to shift with respect to the base to accommodate the slight dimensional variations due to ambient conditions, without wrinkling of the cover 120, as might occur in a situation where the cover is adhered around all of its margins to the base.

Operation of the second embodiment of latching means 150 would be substantially the same as operation of the first embodiment, described above.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A frame for pictures, prints, or the like, comprising:

a relatively rigid, flat base, having marginal edges; the base having a front surface and an opposite rear surface;

a flat cover formed of flexible material having a degree of resiliency; the cover having a front and a rear surface; the rear surface of the cover being placed over the front surface of the base; the cover having a first edge portion and a second edge portion opposite the first edge portion;

latch means secured to the cover at the first edge portion of the cover; the latch means including a relatively rigid relatively rigid strip having greater rigidity than the flexible material of the cover, the strip being located at the first edge portion and also extending in a distance partway from the relatively rigid first edge portion to the second edge portion, and the strip also extending along the first edge portion; the strip including a surface thereof secured to the adjacent surface of the cover, whereby the strip secured to the flexible cover prevents the cover from flexing where the cover surface and strip surface are secured together;

a rigid flap on the rigid strip for extending down the rear surface of the base; the flap having greater rigidity than the flexible material of the cover; the latch means flap being long enough that the relatively rigid flap holds the cover securely on the base;

the cover being secured to the base at a location away from the first edge portion of the cover, thereby enabling the first edge portion to be latched to the base and to be moved away from the base.

2. The frame of claim 1, wherein the cover is secured to the base at the edge of the base that is opposite the first edge portion of the cover.

3. The frame of claim 1, wherein the latch means includes an element for raising the flap away from the rear surface of the cover, for defining a recess between the cover and the flap; where the flap is passed down over the rear of the base, the one marginal edge of the base being held in the recess by the flap.

4. The frame of claim 3, wherein the latch means element comprises a relatively rigid strip of shorter height having a front which is secured behind the rear surface of the cover, such that latching of the latch means on the base involves bending the cover to move the flap over the one marginal edge of the base;

a second relatively rigid strip of greater height, affixed at the rear of the first mentioned strip and having the flap defined thereon and the flap extending further down along the height dimensions of the cover from the bottom edge of the first mentioned strip, thereby defining the recess between the flap and the rear surface of the cover.

5. The frame of claim 4, wherein the first and second mentioned strips are integrated as a single unit.

6. The frame of claim 4, wherein the latch means includes a surface in the recess that faces toward the one marginal edge of the base.

7. The frame of claim 4, wherein the cover is secured to the base at the edge of the base that is opposite the first edge portion of the cover.

8. The frame of claim 4, further comprising an easel attached to the base at the one marginal edge of the base for standing the frame; the easel comprises a member that is hinged to the base to swivel away from the base for standing.

9. The frame of claim 4, wherein the cover is comprised of transparent material; a flexible border being defined on the cover.

10. The claim of either of claims 1 or 3, wherein the latch means is secured behind the rear surface of the cover, such that latching of the latch means on the base involves bending the cover to move the flap over the one marginal edge of the base.

11. The frame of claim 10, wherein the cover is secured to the base at the edge of the base that is opposite the first edge portion of the cover.

12. The frame of claim 1, further comprising an easel attached to the base for standing the frame.

13. The frame of claim 12, wherein the easel comprises a member that is hinged to the base to swivel away from the base.

14. The frame of claim 13, wherein the easel is hinged to the base at the one marginal edge of the base.

15. The frame of either of claims 1 or 4, wherein the cover is comprised of transparent material.

16. The frame of claim 15, further comprising a flexible border defined on the cover.

17. The frame of claim 16, wherein the border comprises a layer of ink.

18. The frame of either of claims 16 or 17, wherein the border is defined on the rear surface of the cover.

19. The frame of claim 16, wherein the border is defined on the front surface of the cover.

20. The frame of either of claims 16 or 19, wherein the border comprises a strip of flexible material that is adhered to the cover.

21. The frame of claim 1, wherein the strip has an edge at the side thereof away from the first edge portion of the cover; the strip edge is opposed to and adjacent the adjacent marginal edge of the base, and there is separation between the strip edge and the adjacent marginal edge of the base.

22. The frame of claim 21, wherein the strip edge is adjacent the adjacent marginal edge of the base along the entire length of the strip along the first edge portion.

* * * * *